US007208710B2

(12) United States Patent
Gregoire et al.

(10) Patent No.: US 7,208,710 B2
(45) Date of Patent: Apr. 24, 2007

(54) UNIFORM MICROWAVE HEATING METHOD AND APPARATUS

(75) Inventors: Daniel Gregoire, Thousand Oaks, CA (US); Joseph Colburn, Pacific Palisades, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 11/504,145

(22) Filed: Aug. 14, 2006

(65) Prior Publication Data

US 2006/0289503 A1 Dec. 28, 2006

Related U.S. Application Data

(62) Division of application No. 10/987,414, filed on Nov. 12, 2004, now abandoned.

(51) Int. Cl.
*H05B 6/70* (2006.01)
*H05B 6/72* (2006.01)

(52) U.S. Cl. ..... 219/697; 219/746; 219/750; 219/747; 333/230

(58) Field of Classification Search ..... 219/695–697, 219/745–750, 756, 762; 333/227–333, 239, 333/242

See application file for complete search history.

(56) References Cited

U.S. PATENT DOCUMENTS

| | | | | |
|---|---|---|---|---|
| 5,008,506 | A * | 4/1991 | Asmussen et al. | 219/696 |
| 5,111,111 | A * | 5/1992 | Stevens et al. | 315/111.41 |
| 5,632,921 | A * | 5/1997 | Risman et al. | 219/750 |
| 2003/0089707 | A1 * | 5/2003 | Fagrell et al. | 219/747 |

* cited by examiner

*Primary Examiner*—Philip H. Leung
(74) *Attorney, Agent, or Firm*—Christie, Parker & Hale, LLP.

(57) ABSTRACT

A method and apparatus for creating uniform heating of an microwave absorptive target. A circularly polarized waveguide mode is created that promotes uniform heating of the microwave absorptive target by rotating a propagated non-uniform field pattern around a central axis of a cylindrical cavity or waveguide. In the process of rotating the field pattern, hot and cold spots in the field pattern are averaged out over time.

4 Claims, 4 Drawing Sheets

UNIFORM MICROWAVE HEATING METHOD AND APPARATUS

CROSS-REFERENCE TO RELATED APPLICATION(S)

The present application is a divisional application of, and claims the benefit of, U.S. patent application Ser. No. 10/987,414 filed Nov. 12, 2004, which is now abandoned.

BACKGROUND OF THE INVENTION

1. Field of the Invention

The present invention relates to the field of heating, and more particularly, to the use of microwave radiation for heating slab-like layers or surfaces.

2. Description of the Related Art

The use of microwave radiation is a well known method for heating substances that have intrinsic absorption properties, but it is often difficult to remove the effects of cavity and waveguide modes that lead to non-uniform heating and "hot spots" in the target to be heated.

Many processes also require uniform heating and a method of applying heat energy noninvasively. For example, the use of microwave heating has been proven to be effective for the processing of dielectric material. In many cases, a uniform temperature distribution within the product is required.

There have been many proposals that use a TEM waveguide mode to create a uniform field distribution. A waveguide or cavity is loaded with high permittivity dielectric materials to enable the uniform TEM mode field distributions. The disadvantage is that many applications do not allow the inclusion of such material within the processing environment. Another disadvantage is that the loading material limits the space available within the cavity for the target.

The use of meta-structures or artificial electromagnetic materials has yielded methods for creating uniform fields within a microwave waveguide or cavity, such as by a rectangular waveguide that utilizes a hard electromagnetic surface to enable TEM waves in a waveguide which is applied to an active amplifier array structure for the purpose of high-frequency amplification for communication purposes. A uniform field distribution is desired in this case because it optimizes the amplifiers performance and efficiency. However, the waveguide structures are complicated multiple-layer structures that must be fabricated within the microwave structure.

Techniques have also been introduced that require a moving structure or a field enhancing structure within the interior of the heating cavity. In many cases, the added complexity is undesirable, such as, for example, a conveyer belt system moving over microwave emitting slots in a waveguide.

Other heating methods employ additional electrical structures within the cavity that alter the field distribution, such as, for example, an inserted control element positioned between an object being heated and a source of microwave radiation and employed to prevent a localized concentration of microwave energy resulting from a discontinuity in the object surface. However, close control is needed for heating an object with a sensitive coating.

High-frequency microwave sources have been proposed to reduce the spatial dimension of field variation and to facilitate the efficacy of multimode methods for time-averaged field uniformity, such as a 28-GHz source used for achieving uniformity within a small volume. This methodology relies on the disadvantage imposed by fixed-frequency microwave heating cavities that are known to have cold spots and hot spots. Such phenomena are attributed to the ratio of the wavelength to the size of the microwave cavity. With a relatively low frequency microwave introduced into a small cavity, standing waves occur and, thus, the microwave power does not uniformly fill all of the space within the cavity, and the unaffected regions are not heated. In the extreme case, the oven cavity becomes practically a "single-mode" cavity. At 2.45 GHz a far better uniformity of field can be obtained by increasing the cavity dimensions better than 100 times the wavelength which would require a cavity size of about 12 m. However, at this size a very large power supply would be required to produce a reasonable energy density within the cavity.

A proposed solution to the large power supply problem has been to go to higher frequencies, as high as 28 GHz where 100 times the wavelength is approximately 1 m in size. This is a far more manageable size of cavity and a reasonable energy density can be obtained with a moderate power source. However, a frequency of 28 GHz is considered to be prohibitively expensive for commercial use.

Hybrid heating ovens that incorporate airflow with the microwave heating are known to increase uniformity via convective heat transfer. However, in many cases, the increased complexity of introducing the airflow is prohibitive, or the desired process may be degraded by airflow.

In another method, a central conductor is imposed within a waveguide heating cavity to create the TEM field distribution. The central conductor is used as an air flow device to help unify the heating. However, many applications will not allow a central conductor within a heating cavity, such as, for example, a home microwave oven. In addition, TEM modes created in coaxial structures have electric fields that are non-uniform, falling off as the inverse of the distance from the axial conductor.

Attempts have also been made at mode stirring, or randomly deflecting the microwave beam, in order to break up the standing modes and thereby fill the cavity with the microwave radiation. One such attempt is the addition of rotating fan blades at the beam entrance of the cavity. This is essentially an empirical, non-deterministic technique based on statistical fluctuations in mode patterns. In cases where the cavity size is not large compared to a microwave wavelength, the number of modes available to be stirred is small and the statistical averaging in ineffective. These methods also rely on the inclusion of mechanical or electronic devices required to operate within the high-field, high-temperature processing environment. In many applications, this is undesirable.

A further method extending the deflecting approach involves the use of a circular cylindrical geometry where a bellows-type device is used to change the cavity's electrical length. By rapidly oscillating the length, many modes can come to bear on the sample and average out the heating to be more uniform. However, this requires a highly overmoded cavity and a complicated moving mechanical structure.

Another general method used to overcome the adverse effects of standing waves is to intentionally create a standing wave within a single-mode cavity such that the target may be placed at the location determined to have the highest power (the hot spot). Thus, only the portion of the cavity in which the standing wave is most concentrated will be used. This requires that the heating target is small compared to the cavity size and/or the mode structure cannot be altered from one target to another. It also does not lend itself to mass production, since other microwave cavity tuning devices, such as tuning stubs, are necessary for tuning the cavity for the desired mode. If the dielectric properties of the target change as it heats up, then the cavity resonance properties will also change, and the field distributions will also change in time.

Multiple microwave power sources and variable-frequency microwave sources are other solutions that have been proposed. The uniformity achieved through these approaches is dependent on having a statistically large number of modes available within the cavity, and they will work best when the cavity size is large compared to a wavelength. However, they impose a cost disadvantage. While 2.45 GHz/2 kW sources are very inexpensive and plentiful, any deviation from these parameters requires custom fabrication. A variable frequency source is potentially inexpensive at low power (e.g. a VCO), but they require high-power microwave amplifiers (>1 kW), which are virtually nonexistent for less than a few hundreds of thousands of dollars.

Other techniques have been proposed to move the target around within the cavity. The disadvantages here are that a mechanical device is necessary to move the target, and the target only can occupy a small portion of the cavity.

Therefore, a need exists for a better way of providing uniform microwave heating. Embodiments of the present invention provide solutions to meet such need.

SUMMARY OF THE INVENTION

In accordance with the present invention a method is provided for creating uniform heating of an absorptive target, and, is particularly useful for heating a large-area slab-like or substrate absorptive target.

In one aspect of the invention a circularly polarized waveguide mode is created that will promote uniform heating by rotating a propagated non-uniform field pattern around a central axis of a cylindrical cavity or waveguide. In the process of rotating the field pattern, hot and cold spots in the field pattern are averaged out over time. Exemplary embodiments of the present invention operate with a single high-power (>1 kW) source, such that multiple power sources are not required as in other state-of-the-art methods. Multiple microwave power feeds are introduced into the system, each one with a fixed phase shift from the other.

In one aspect providing uniform microwave heating of a microwave absorptive target in accordance with the present invention, a microwave housing having a longitudinal axis is sized to propagate a selected waveguide mode at an operating frequency. The microwave absorptive target is located in an axial cross-sectional area of the microwave housing relative to the longitudinal axis. Microwave energy at the operating frequency is applied into the microwave housing to propagate a circularly polarized waveguide mode in the microwave housing to time average azimuthal field strength across the axial cross-sectional area. The applied microwave energy may be split into a first signal and a second signal ninety degrees out of phase with the first signal. The first signal and the second signal may be applied into the microwave housing at ninety angular degrees apart azimuthally relative to the longitudinal axis to provide the first signal and the second signal into the microwave housing as respective orthogonal components of an applied field strength. The applied microwave energy may alternatively be split into a first signal and a second signal in phase with the first signal. The first signal and the second signal may then be applied into the microwave housing ninety angular degrees apart azimuthally relative to the longitudinal axis to provide the first signal and the second signal into the microwave cavity as respective orthogonal components of an applied field strength, but separated apart longitudinally an operating frequency quarter wavelength. The microwave housing may be a resonant cavity or a microwave waveguide.

In another aspect providing uniform microwave heating of a microwave absorptive target in accordance with the present invention, a microwave housing having a longitudinal axis is sized to propagate a selected plurality of waveguide modes at an operating frequency. The microwave absorptive target is located in an axial cross-sectional area of the microwave housing relative to the longitudinal axis. The microwave energy at the operating frequency is applied into the microwave housing to propagate circularly polarized waveguide modes of the selected plurality of waveguide modes to time average a combined azimuthal field strength from the selected plurality of circularly polarized waveguide modes across the axial cross-sectional area. The applied microwave energy at the operating frequency may be split into a first signal and a second signal ninety degrees out of phase with the first signal. The first signal and the second signal may be applied into the microwave housing ninety angular degrees apart azimuthally relative to the longitudinal axis to provide the first signal and the second signal into the microwave housing as respective orthogonal components of an applied field strength of each of the selected plurality of waveguide modes. The microwave housing may similarly be a resonant cavity or a microwave waveguide.

DETAILED DESCRIPTION OF THE INVENTION

When using microwaves to heat various materials for various purposes, one usually has to live with an inherent non-uniformity in the heating of the target material, due to electromagnetic modes that constrain the heating energy to specific patterns within the heating cavity. Considering that the cavity typically consists of a cylindrical geometry of arbitrary cross section, the most common being rectangular or circular. Microwave radiation is introduced into the cavity at a coupler port designed for that purpose. The electromagnetic radiation within the cavity is distributed among several orthonormal cavity modes. Each mode is a solution to the Maxwell's wave equation given the cavity's particular boundary conditions.

Figure 1:
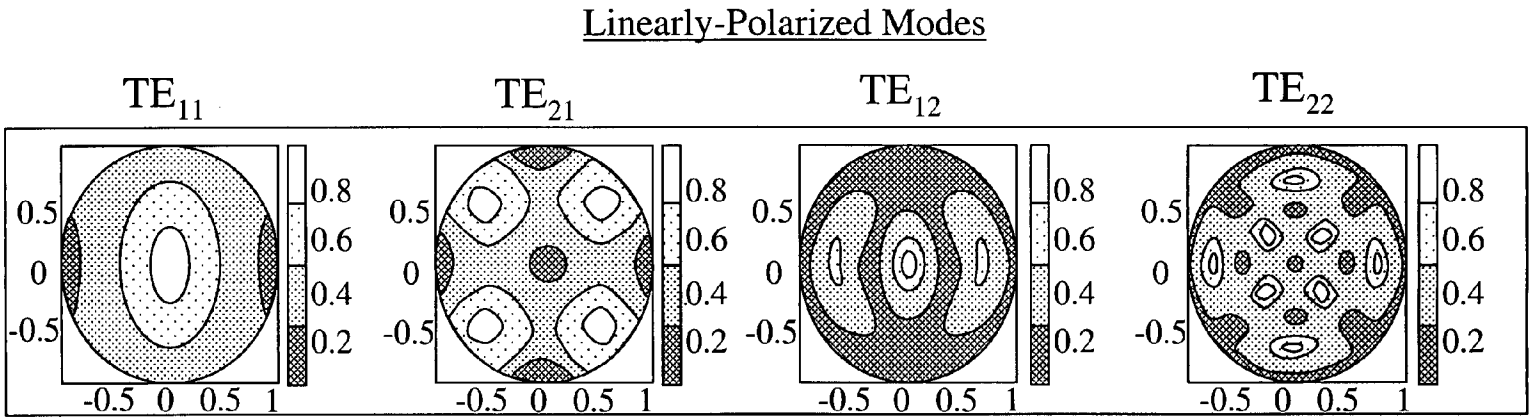
FIG. 1 depicts heat intensities resulting from various linear polarized TE modes propagating in a right circular cylindrical microwave cavity or waveguide.

FIG. 1 illustrates the heating pattern intensity as a function of radius that would be experienced by targets placed across the cross section of a right circular cylindrical cavity (or waveguide) with conductive walls and tuned to support various linearly polarized (LP) cavity modes: $TE_{11}$, $TE_{21}$, $TE_{12}$ and $TE_{22}$. Depicted heating intensity increases from the dark areas to the light areas.

Figure 2:
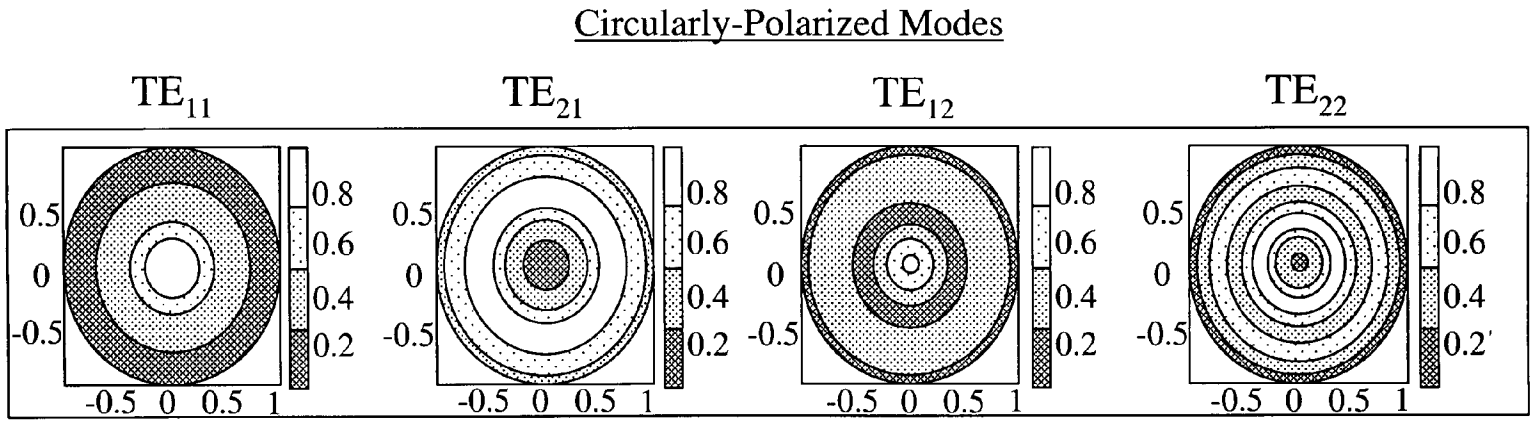
FIG. 2 depicts heat intensities resulting from various circularly polarized TE modes propagating in a right circular cylindrical microwave cavity or waveguide.

FIG. 2 illustrates the heating pattern intensity as a function of radius that would be experienced by targets placed across the cross section of a right circular cylindrical cavity (or waveguide) with conductive walls and tuned to support various circularly polarized (CP) cavity modes: $TE_{11}$, $TE_{21}$, $TE_{12}$ and $TE_{22}$. Depicted heating intensity similarly increases from the dark areas to the light areas.

As can be seen comparing FIGS. 1 and 2, when the cavity/waveguide modes are excited in a circular polarization, as in accordance with the present invention, then the mode patterns are time-averaged azimuthally to smooth out the hot and cold spots in the heating pattern. As seen in FIG. 2, the CP-modes show an azimuthally symmetric heating pattern. The circularly polarized $TE_{11}$, $TE_{21}$ and $TE_{22}$ modes exhibit uniformity of better than 50% variation over a subset of more than half of the cross sectional area.

Figure 3:
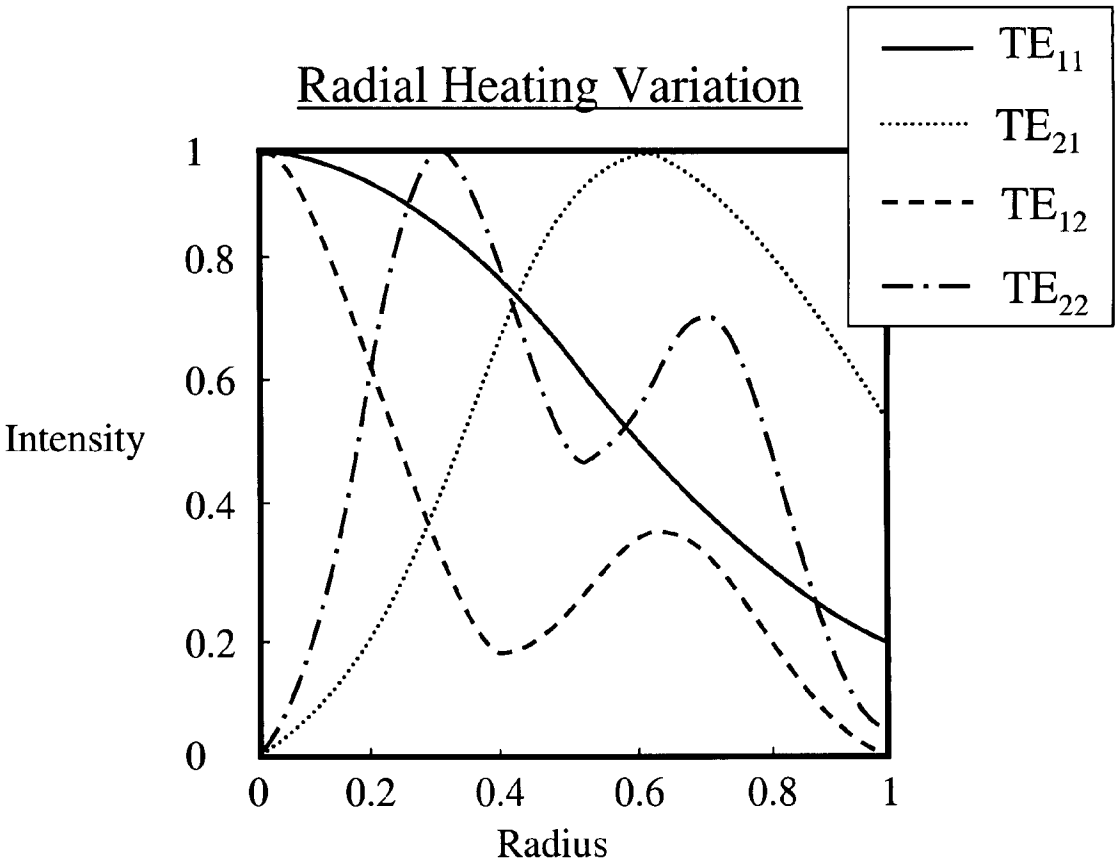
FIG. 3 is a graph showing radial heat variation for various circularly polarized TE modes propagating in a right circular cylindrical microwave cavity or waveguide.

However, radial variation still exists, and is seen as pronounced cold spots in the CP-mode heating patterns. For example, as seen in FIG. 2 the CP-$TE_{21}$ mode has a cold spot on center, while the CP-$TE_{11}$ mode has a cold ring near the wall, and the CP-$TE_{22}$ and CP-$TE_{12}$ modes have more than one cold ring. However, as can be seen in FIG. 3 which compares the heating intensity vs. radial distance from the waveguide center for each of the CP modes, the $TE_{11}$, $TE_{21}$ and $TE_{22}$ modes exhibit variation of less than 50% over a subset of more than 50% of the cross sectional surface area. This is a significant improvement over the LP modes' heating patterns. If the heating application is amenable such that the target does not need to span the entire cavity diameter, then any one of these modes is a good choice for heating.

Other higher modes can exhibit even better uniformity, especially modes like CP-$TE_{mn}$ where m and n are both large integers. However, modes of very high order require either higher frequency or larger cavity diameter to be supported, and in general, many applications will not tolerate the increase in either parameter.

Figure 4:
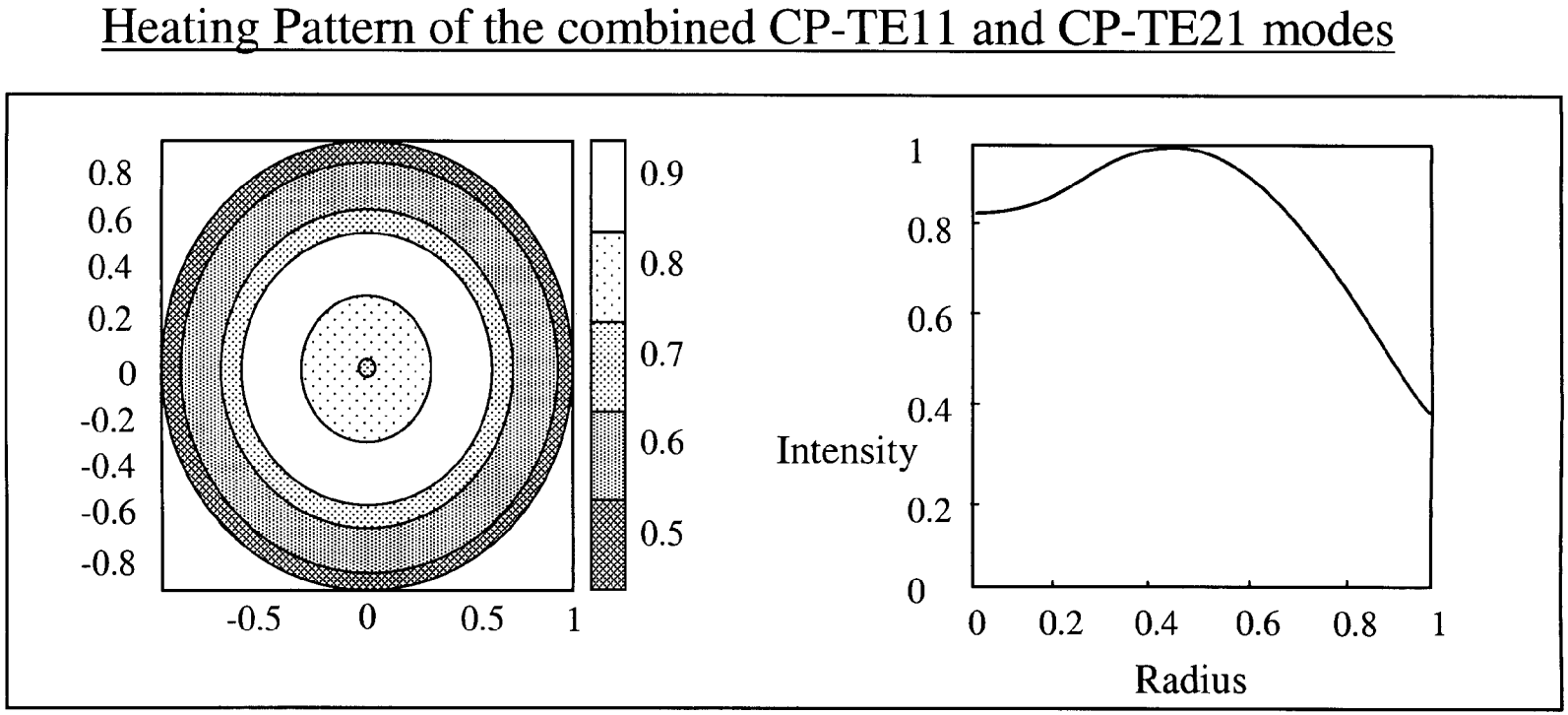
FIG. 4 depicts the heating pattern of a combined circularly polarized $TE_{11}$ and $TE_{21}$ modes propagating in a right circular cylindrical microwave cavity or waveguide.

In order to overcome the shortcomings of the single CP-mode heating patterns, and to activate more of the cross-sectional area for uniform heating, it is possible to excite combinations of CP-modes that will overlap to eliminate radial cold rings from the heating profile. As seen in FIG. 4, which depicts heating pattern intensities for the combination of the CP-$TE_{11}$ and the CP-$TE_{21}$ modes, the modes overlap to eliminate the hot spots in the center and at the walls as seen with the modes separately. In the right side graph of FIG. 4, the pattern is shown varying less than 50% over the total cross section, and even varying less than 20% over 70% of the radius.

Figure 6:
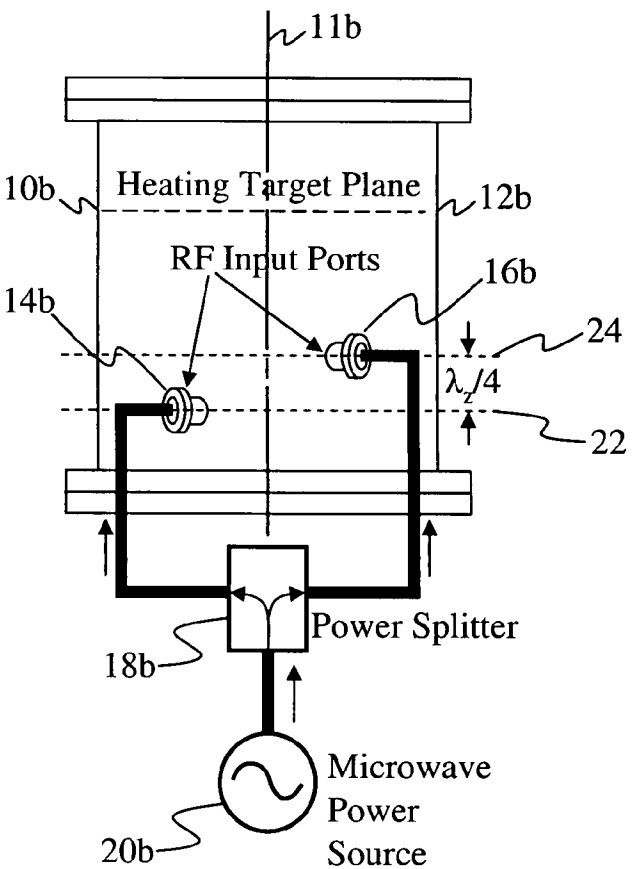
FIG. 6 shows a schematic representation of a second exemplary embodiment of the present invention.
Figure 5:
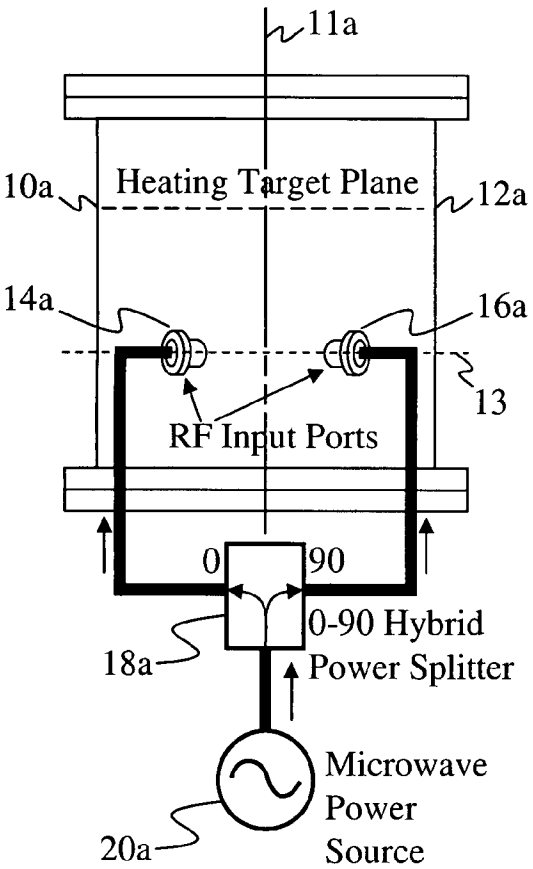
FIG. 5 shows a schematic representation of a first exemplary embodiment of the present invention.

Referring now to FIGS. 5 and 6, two respective schematic embodiments are shown wherein each employs a high-power (>1 kW) microwave source, a circularly-cylindrical heating cavity (or waveguide) with two RF power coupling ports separated by 90 degrees on the chamber's azimuth plane to provide respective $E_x$, and $E_y$ fields, a heating target plane in which the target substrate/slab is situated, and a low-loss RF power splitter.

In application, a substrate holder is mounted within microwave housings 10*a*, 10*b* on axial cross-sectional plane 12*a*, 12*b* relative to longitudinal axis 11*a*, 11*b*. The holder is intended to hold a target material or object that is desired to be heated uniformly across its volume. The heating may take place through microwave absorption within the target itself or the substrate holder may be embedded with microwave absorbing material that comes in contact with the target.

In the first embodiment shown in FIG. 5, input ports 14*a*, 16*a* are situated on the same plane 13 perpendicular to the housing axis, and 0–90 hybrid power splitter 18*a* supplies power (typically >1 kW) to each of the two ports from microwave power source 20*a*, the respective power being split ninety degrees in phase.

In the second embodiment shown in FIG. 6, two input ports 14*b*, 16*b* are situated azimuthally as in the first embodiment but are separated longitudinally by a distance equal to a 90-degree phase shift of the electromagnetic cavity mode used to heat the target, and power splitter 18*b* provides power (typically >1 kW) at the same phase to each port from power source 20*b*.

The result of each power splitter and port configuration is to create a circularly polarized mode within the heating cavity, which will tend to eliminate any azimuthal variation in the heating patterns as described above.

Referring now to FIG. 5 in more detail regarding the first embodiment, 0–90 hybrid power splitter 18*a* modifies the power. The junction divides the input power equally between the two output ports while simultaneously shifting the phase of one of the output ports by 90 degrees. The junction ports are connected via a low loss connection to two ports 14*a*, 16*a* on microwave cavity or waveguide 10*a*. The two ports 14*a*, 16*a* are situated on the plane of a circular cross section and they are spaced with an angular separation of 90 degrees to create the respective $E_x$ and $E_y$ fields. The collective effect of the port spacing and the 90-degree phase shifts in the power signals is to excite a circularly polarized mode within the waveguide/cavity.

Referring now to FIG. 6 for more detail regarding the second embodiment, a circularly polarized wave is also similarly excited in waveguide/cavity 10*b*, but the effect is achieved with a modified port and microwave configuration. This second embodiment is simplified from the first embodiment by the use of two-port power splitter 18*b* rather than a 0–90 hybrid power splitter as in the first embodiment. The second embodiment port configuration differs from the first embodiment port configuration in that ports 14*b*, 16*b* are still spaced azimuthally 90 degrees apart with respect to the cylindrical axis, but they now lie in two different cross-sectional planes 22, 24 that are separated by a spacing that corresponds to a 90 degree phase shift of the wave traveling along the cavity axis. This configuration is confined to the use of a single frequency and a single waveguide mode that correspond with the ports' axial spacing. The relationship between the port axial spacing, the source frequency, the cavity dimensions and the waveguide mode parameters is $\pi/2=LB_z$, where L is the cavity length and $B_z$ is the axial wavenumber of the desired mode within the cavity.

In the case of waveguide housings, the input port couplers are designed to support the desired modes, such as providing a coaxial line to waveguide transition structure to create a desired traveling wave mode.

In the case of cavity housings the coupler design is not as critical, and the cavity is instead designed to be resonant at the desired mode. Those skilled in the art can readily appreciate that this is easily achieved by changing the cavity end conditions, i.e. change its length, such that the cavity cross-section and length combination, at a desired resonant frequency (e.g., 2.45 GHz) produces the desired mode.

With regard to the combined CP-modes embodiment, standard microwave excitation techniques can be used to simultaneously excite the two CP-modes within the cavity. One method for the simultaneous excitation is to design the cavity radius and length to be simultaneously resonant in both modes by satisfying the resonant length equations for both modes:

$$LB_{zTE11}=n \text{ and } LB_{zTE21}=m$$

where L is the cavity length, m and n are integers, and $B_z$ are the respective axial mode wavenumbers.

Therefore, in accordance with the present invention, a uniform microwave heating capability over a large surface area has been described. Those skilled in the art can appreciate also that the target area may be altered to facilitate heating by the inclusion of a microwave-absorbing material. The target area may also be composed of a mixture of material to be processed at a specific temperature. The target area may include a catalyst that is activated at a high temperature to enable a process. The target may include a combustible material that requires a uniform heating profile to burn evenly.

The thermal energy delivered to the process area by electromagnetic absorption of microwave radiation will be applicable to processes where uniform heating is necessary to meet process specification.

In accordance with embodiments of the present invention, a uniform field of electromagnetic energy can be delivered over a large surface cross section. A non-invasive method of heating substrates is provided. Generally available commercial high-power magnetron microwaves sources may be used. While exemplary embodiments may conveniently operate at 2.45 GHz, a frequency where cheap, reliable and high-power microwave sources are available, but this is not required. Since the source operates at fixed frequency, it is routine to design and fabricate the low-loss, narrow-bandwidth components necessary to complete the design.

Embodiments of the present invention have many potential uses. For example, auto manufacturers may be interested in developing new, efficient and cheap methods for reducing exhaust emissions from internal combustion engines. Embodiments of the present invention could be employed for the purpose of heating catalysts or substrates in exhaust cleansing devices. In particular, the device could be used for burning the particulate residue out of diesel engine particulate traps.

Materials manufacturers could use the invention to provide a large area of uniform heating in materials processing stations. For example, deposition of diamond or diamond-like-carbon films used for thermal control requires the substrate to be uniformly heated in order to create a large-area diamond substrate of uniform quality.

The device could also be used to permit higher power levels to be transmitted in a waveguide of a given size; or equivalently, a smaller waveguide to be used for a given power. This may be useful in radar transmitters, for example, where compactness is otherwise difficult to achieve without compromising reliability; or in high-power-microwave weapons, where high power and energy densities are essential.

Other possible applications include sterilization of non-metallic medical equipment or contaminated wastes, cooking food, sintering ceramics, sintering nano materials, and diamond and diamond-like deposition.

What is claimed is:

1. A method for uniform microwave heating of a microwave absorptive target comprising:

sizing a microwave housing having a longitudinal axis to propagate a selected waveguide mode at an operating frequency;

locating the microwave absorptive target in an axial cross-sectional area of the microwave housing relative to the longitudinal axis; and applying microwave energy at the operating frequency into the microwave housing to propagate a circularly polarized waveguide mode in the microwave housing to time average azimuthal field strength across the axial cross-sectional area, by:

splitting the applied microwave energy into a first signal and a second signal in phase with the first signal; and applying the first signal and the second signal into the microwave housing:

ninety angular degrees apart azimuthally relative to the longitudinal axis to provide the first signal and the second signal into the microwave cavity as respective orthogonal components of an applied field strength, and separated apart longitudinally an operating frequency quarter wavelength.

2. The method of claim 1, wherein the microwave housing is a resonant cavity or a microwave waveguide.

3. A microwave heating apparatus for uniform heating of a microwave absorptive target comprising:

a microwave housing having a longitudinal axis and sized to propagate a selected waveguide mode at an operating frequency, the microwave housing having an axial cross-sectional area relative to the longitudinal axis for locating the microwave absorptive target; and a microwave energy feed system operating at the operating frequency and coupled to the microwave housing to propagate a circularly polarized waveguide mode in the microwave housing to time average azimuthal field strength across the axial cross-sectional area, wherein the microwave energy feed system includes:

a splitter for splitting the applied microwave energy into a first signal and a second signal in phase with the first signal; and respective input ports for applying the first signal and the second signal into the microwave housing ninety angular degrees apart azimuthally relative to the longitudinal axis to provide the first signal and the second signal into the microwave cavity as respective orthogonal components of an applied field strength, and separated apart longitudinally an operating frequency quarter wavelength.

4. The microwave heating apparatus of claim 3, wherein the microwave housing is a resonant cavity or a waveguide.

* * * * *